US007709741B2

(12) United States Patent
Reichert et al.

(10) Patent No.: US 7,709,741 B2
(45) Date of Patent: May 4, 2010

(54) FLAT CABLE

(75) Inventors: Rudolf Reichert, Pleinfeld (DE); Joachim Mueller, Pleinfeld (DE)

(73) Assignee: W. L. Gore & Associates GmbH, Putzbrunn (DE)

( * ) Notice: Subject to any disclaimer, the term of this patent is extended or adjusted under 35 U.S.C. 154(b) by 650 days.

(21) Appl. No.: 10/564,301

(22) PCT Filed: Jul. 9, 2004

(86) PCT No.: PCT/EP2004/007589

§ 371 (c)(1),
(2), (4) Date: Feb. 22, 2007

(87) PCT Pub. No.: WO2005/008686

PCT Pub. Date: Jan. 27, 2005

(65) Prior Publication Data

US 2007/0240898 A1 Oct. 18, 2007

(30) Foreign Application Priority Data

Jul. 11, 2003 (DE) ..... 10 331 710

(51) Int. Cl.
*H01B 7/00* (2006.01)

(52) U.S. Cl. ..... 174/117 F; 174/117 FF

(58) Field of Classification Search ..... 174/110 R, 174/113 R, 117 R, 117 F, 117 FF
See application file for complete search history.

(56) References Cited

U.S. PATENT DOCUMENTS 4,149,026 A * 4/1979 Fritz et al. ..... 174/32
4,219,928 A * 9/1980 Kuo ..... 29/868
4,381,420 A * 4/1983 Elliott et al. ..... 174/34
4,382,236 A * 5/1983 Suzuki ..... 333/1
4,490,690 A * 12/1984 Suzuki ..... 333/1
4,578,529 A * 3/1986 Look ..... 174/117 FF
4,639,693 A * 1/1987 Suzuki et al. ..... 333/1
4,658,090 A * 4/1987 Coon ..... 174/119 R
4,707,671 A * 11/1987 Suzuki et al. ..... 333/1
4,748,293 A * 5/1988 Kikuchi et al. ..... 174/268
4,798,918 A * 1/1989 Kabadi et al. ..... 174/36
4,832,621 A * 5/1989 Asai et al. ..... 439/492
4,845,311 A * 7/1989 Schreiber et al. ..... 174/36
5,003,126 A * 3/1991 Fujii et al. ..... 174/36
5,235,132 A * 8/1993 Ainsworth et al. ..... 174/36
5,446,239 A * 8/1995 Mizutani et al. ..... 174/36
6,586,757 B2 * 7/2003 Melnychuk et al. ..... 250/504 R

FOREIGN PATENT DOCUMENTS

EP 1 271 563 A1 6/2001
EP 0 961 298 B1 9/2001
EP 0 903 757 B1 2/2003

* cited by examiner

*Primary Examiner*—William H Mayo, III
(74) *Attorney, Agent, or Firm*—Allan M. Wheatcraft

(57) ABSTRACT

A flat cable having at least two conductor planes, in which a number of electrical conductors running in the longitudinal direction of the cable are arranged, in which the electrical conductors in the flat cable thickness direction and/or in the flat cable width direction are kept at a defined distance from each other by means of a central insulation layer of predetermined thickness acting as a spacer insulator and are electrically insulated and positioned relative to each other and to the flat cable exterior by means of an outer insulation layer.

16 Claims, 12 Drawing Sheets

FLAT CABLE

FIELD OF THE INVENTION

The invention relates to a flat cable, its use and a method for its production.

BACKGROUND OF THE INVENTION

Flat cables, which not only have the smallest possible dimensions and high permanent flexibility, but also permit transmission of very high data rates with minimal transit time differences, for example, in the range of 2.5 Gbit/s, are required for certain applications. Such applications include mobile telephones, PDAs (personal digital system) or small computers called palmtops and laptops, which have parts that can be tilted and/or rotated relative to each other, between which high-speed data transmission is required. Because of the small dimensions, especially in the case of mobile telephones and PDAs, such data connections must be produced via flat cables with the smallest possible dimensions, even micro flat cables.

Particularly reliable data transmission is obtained with so-called differential signal transmission, in which the data pulses being transmitted are transmitted via two signal conductors, in non-negated form via one of the two signal conductors and in negated form via the other signal conductor. A specific data bit is therefore transmitted on one of the two signal conductors with high potential and, at the same time, on the other of the two signal conductors with low potential, in which case descending flanks occur on one of the two signal conductors during rising flanks on the other of the two signal conductors and vice versa. This differential signal transmission, with opposite pulse shape over the two signal conductors, permits particularly reliable data transmission. Common-mode disturbances, like crosstalk, are filtered out by the differential signal transmission and disturbances from radiation and emission are significantly reduced.

A cable having very high uniformity with respect to impedance and surge impedance is required for high-speed data transmission. In a flat cable, this means that electrical conductors adjacent to each other, separated by a dielectric, which form a signal conductor pair, must have a spacing from each other that not only must be very well defined, but also must have high-grade uniformity. This uniformity must not only be ensured over the entire length of the cable, but also during operation of the cable, during which bending, twisting and/or flexing movements of the cable must not lead to a change in impedance.

In the context of the present disclosure, the term adjacent is understood to mean proximity in the flat cable thickness direction and/or in the flat cable width direction.

The electrical parameters required for electrical cables that must be suitable for high-speed data transmission are determined quite essentially by the spacing between the two signal conductors, apart from the material of the dielectrics separating the two signal conductors. This is particularly true for the impedance or surge impedance. Ordinary flat cables are one-layered, i.e., all their electrical conductors are situated in the same plane. Common examples of this are shown in EP 1 271 563 A1, EP 0 961 298 B1 and EP 0 903 757 B1. In all these known flat cables, the electrical conductors are embedded between two insulation sheets corresponding to the width of the flat cable, in which shielding is additionally provided in the case of EP 0 903 757 B1, formed by two electrically conducting layers that enclose the outsides of the two insulation sheets. These cables are suitable only for low frequencies and, in the case of a shielded version, the flexibility and packing density necessary for the applications mentioned in the introduction cannot be reached. The unshielded versions are often not satisfactory with respect to EMC (electromagnetic compatibility) either.

Alternative solutions, like shielded flexible circuit boards and shielded one-layered flat cables, do not satisfy the typical mechanical flex-lifetime requirements of several hundred thousand flex cycles, as are common in the devices mentioned in the introduction with parts that are movable relative to each other.

With the usual methods and equipment for the production of flat cables, it is not possible to ensure a spacing between the electrical conductors lying next to each other in the flat cable width direction with as high a uniformity as would be required for uniformity of impedance of a flat cable suitable for high-speed data transmission.

SUMMARY OF THE INVENTION

The underlying task of the invention is to devise a flat cable that can be produced with the dimensions of a micro cable. High impedance and transit time precision between adjacent signal conductors of a single conductor pair are to be made possible with uniformity high enough for the flat cable to be used for high-speed data transmission.

This is achieved with a flat cable of the type mentioned in claim 1 or 6, which can be used according to claim 14. Embodiments and modifications are mentioned in the dependent claims.

The invention therefore devises a flat cable having at least two conductor planes, in which a number of electrical conductors running in the longitudinal direction of the cable are arranged, in which the electrical conductors in the flat cable thickness direction and/or in the flat cable width direction are kept at a defined distance from each other by means of a central insulation layer of predetermined thickness acting as a spacer insulator and are electrically insulated and positioned relative to each other and to the flat cable exterior by means of an outer insulation layer. The central insulation layer is then situated horizontally and/or vertically between two adjacent conductors. In the case of vertical central insulation arrangement, one central insulation layer is situated between a pair of conductors situated one above the other and an adjacent pair or conductors situated one above the other. A material selection is made for the central insulation layer and the outer insulation layer, so that the central insulation layer has greater hardness than the outer insulation layer material, and to such a degree that, when compressive force is exerted by the electrical conductors on the flat cable, increasing in the flat cable thickness direction, the outer insulation layer material is displaced rather than the central insulation layer material.

In embodiments of the invention, the central insulation layer and/or the outer insulation layers of the flat cable are formed by sheet-like insulation material. However, there is also the possibility of producing the flat cable during extrusion of the insulation layer.

Owing to the fact that the distance of the electrical conductors belonging to the different conductor planes is determined by the central insulation layer, which can be produced with very high uniformity with respect to thickness, because of the material selection according to the invention, very high uniformity can be produced for the impedance between adjacent conductors. In addition, better flex properties are achieved with such a flat cable than with ordinary one-layer flat cables with shielding.

This has two quite critical advantages. On the one hand, during production of the flat cable, which will be taken up further below, a situation is prevented in which, during compression of the flat cable components for their joining to a flat cable, the electrical conductors are forced into the central insulation layer and, because of this, a change in its thickness occurs, which, in turn, causes a change in impedance. If compression of the flat cable components during production of the flat cable has the effect of causing the electrical conductors to displace the enclosing insulation layer material, displacement of the softer outer insulation layer material occurs and the harder central insulation layer material is protected from such displacement. If, on the other hand, during bending, twisting or flexing movements of the flat cable in use, strong bending occurs or even exertion of a pressure on the flat cable, displacement of the outer insulation layer material, but not the central insulation layer material, also occurs in this case. Even in a flat cable loaded by bending, twisting or flexing movements, the uniformity of distance between the signal conductors of the two conductor planes is therefore retained and uniformity of impedance between these conductors of the flat cable is therefore obtained.

In one embodiment of the invention, all the electrical conductors are designed as round conductors. In another embodiment, all the conductors are designed as flat conductors. In another embodiment, some of the conductors are designed as round conductors and the rest as flat conductors.

In addition, the invention creates a flat cable in which some of the conductors are designed as narrow conductors and the rest as wide flat conductors, two narrow conductors of the same conductor plane form a conductor pair and a wider flat conductor of the other conductor plane is assigned to each of these conductor pairs, in which the wide flat conductors have a width and position, so that each of them extends width-wise over the entire width of an opposite conductor pair of the other conductor plane. This type of flat cable is particularly well suited for differential signal transmission in the high frequency range.

When the flat cable according to the invention is used for differential signal transmission, two adjacent electrical conductors that belong either to different conductor planes or to the same conductor plane are used as a signal conductor pair for differential signal transmission. A ground conductor pair lies opposite each such signal conductor pair, or, which leads to even better suitability for differential signal transmission, a single common ground conductor extends width-wise over the entire width of the opposite signal conductor pair.

Since common-mode disturbances, for example, crosstalk, are filtered out during differential signal transmission with signal conductor pairs, as already mentioned, and disturbances from radiation and emission are significantly reduced, no additional cable shielding is required. Consequently, higher mechanical loadability and better bending properties are achieved with a flat cable according to the invention than the ordinary one-layer flat cables have, which have shielding layers, in addition to the signal conductors.

In one embodiment of the invention with signal conductor pairs and corresponding ground conductors, narrow conductors are situated in one of the two conductor planes and wide, flat conductors in the other conductor plane. In this case, two adjacent narrow conductors of one conductor plane form a signal conductor pair, whereas the wide, flat conductor in the other conductor plane serves as a reference or ground potential conductor for an adjacent pair of narrow signal conductors. The wide, flat conductors then have a width and relative position, so that each of the wide, flat conductors spans a corresponding pair of narrow signal conductors of the other conductor plane width-wise, but does not necessarily extend beyond them. The distance of the narrow conductors and wide, flat conductors in the thickness direction of the flat cable is also determined in this embodiment by the central insulation layer and can therefore be maintained with high uniformity. In a flat cable of this embodiment, the impedance between two narrow conductors forming a signal conductor pair is not determined primarily by their distance from each other, but by the distance that these narrow signal conductors have from the corresponding wide, flat conductor in the flat cable thickness direction. Since this distance can be maintained by means of the central insulation layer with high accuracy and uniformity, highly uniform differential impedance can be achieved in this flat cable design even between adjacent signal conductors that are situated in the same conductor plane.

In the embodiment with wide, flat conductors in one conductor plane, the signal conductors in the other conductor plane can either be designed as round conductors or as narrow, flat conductors relative to the wide, flat conductors.

In one embodiment of the invention, adjacent wide, flat conductors or groups of wide, flat conductors are situated in the flat cable width direction in alternation in one and the other conductor plane with correspondingly alternating arrangement of the corresponding narrow conductors of the one or other conductor plane.

In the method according to the invention, a roll arrangement is used, having two rotatable rolls arranged parallel to each other, each of which has a number of annular grooves spaced axially from each other on its outer periphery to guide an electrical conductor, in which the profile of the individual annular grooves is adapted to the profile of the electrical conductor that is to be guided in the corresponding annular groove. The two rolls are adjusted to a predetermined radial spacing from each other, so that a gap is formed between the two rolls with a gap thickness that is smaller than the sum of the thicknesses of the three insulation layers, so that, during passage of the individual components of the flat cable through this gap between the rolls, a sufficient pressure is exerted on these components, in order to cause their bonding to the flat cable. Because of the already mentioned material hardness selection for the insulation layers, it is ensured that the compression exerted by the two rolls on the flat cable components, in order to bond them to the flat cable, means that a displacement caused by the electrical conductors of the insulation layer material is active in the outer insulation layers and not in the central insulation layer.

In one embodiment of the method according to the invention, the insulation layers are bonded to each other by means of an adhesive applied to them beforehand with inclusion of the electrical conductors. In another embodiment of the method according to the invention, the insulation layers are heated by means of a heated roll arrangement during passage through the gap between the two rolls to an extent so that they melt and hot gluing of the adhesion layers together based on this melting occurs. During use of a heat-activatable adhesive, heating also occurs via the rolls.

In another embodiment, the flat cable is produced by extrusion.

DESCRIPTION OF THE DRAWINGS

The invention is now further explained by means of practical examples with reference to the drawings. In the drawings.

DETAILED DESCRIPTION OF THE INVENTION

In the following explanation of the drawings terms, like vertical, horizontal, upper, lower, left and right are used, which refer only to the depiction in the correspondingly treated figure, for the correspondingly treated flat cable, but have no absolute meaning and no longer apply in a position different than the one depicted.

Figure 1:
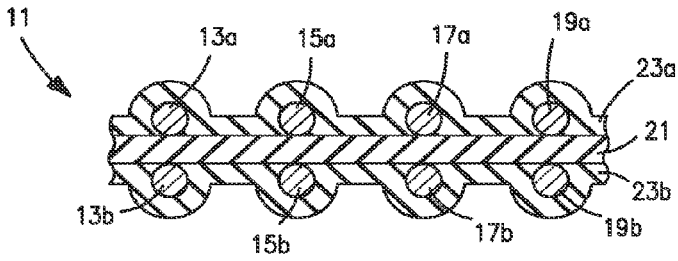
FIG. 1 shows a first embodiment of a flat cable according to the invention.

FIG. 1 shows in a cross-sectional view part of the width of a flat cable 1 according to the invention with electrical round conductors 13*a*, 15*a*, 17*a* and 19*a*, which are situated in an upper conductor plane, and electrical round conductors 13*b*, 15*b*, 17*b* and 19*b*, which are situated in a lower conductor plane. When this flat cable is used for differential signal transmission, the electrical conductors 13*a*, 13*b* form a first differential signal conductor pair, the electrical conductors 15*a* and 15*b* form a second differential signal conductor pair, etc. A practical embodiment of such a flat cable can have more or less than the four signal conductor pairs depicted in FIG. 1.

A central insulation layer 21, acting as spacer insulator, is situated between the conductors of the upper conductor plane and the conductors of the lower conductor plane, by means of which the signal conductors 13*a* to 19*a* of the upper conductor plane and the signal conductors 13*b* to 19*b* of the lower conductor plane are kept at a uniform, defined spacing from each other. The central insulation layer 21 consists of an insulating material of appropriate dielectric constant. For example, the central insulation layer 21 consists of PTFE (polytetrafluoroethylene). ePTFE, i.e., expanded, microporous PTFE, is particularly suitable. ePTFE has a dielectric constant $\in_r$ in the range from about 1.2 to about 2.1 and is therefore particularly suitable as dielectric material of high-frequency cables.

The electrical insulation of signal conductors 13*a* to 19*b*, relative to each other and to the outside of the flat cable, occurs by means of an upper outer insulation layer 23*a* and by means of a lower outer insulation layer 23*b*. As a result of the process, by means of which the flat cable is produced, and which is further explained below, the outer insulation layers 23*a* and 23*b* are beveled around the sides of signal conductors 13*a* to 19*b* lying away from the signal insulation layer 21, as shown in FIG. 1.

In one embodiment, the two outer insulation layers 23*a* and 23*b* also consist of PTFE, preferably also ePTFE. The aforementioned hardness ration between ePTFE and the central insulation 21 and ePTFE of the outer insulation layers 23*a* and 23*b* is maintained.

In practical embodiments of the flat cable depicted in FIG. 1 as micro flat cable, round conductors with a diameter in the range from about 0.05 mm (AWG 44) to about 0.13 mm (AWG 36) are used in each conductor plane, in which AWG stands for American Wire Gauge, and the round conductors have a center spacing about 0.2 mm to 0.3 mm (9 mil to 12 mil) from each other, the conductors forming the corresponding signal conductor pair of the upper conductor plane and the lower conductor plane have a center spacing of about 150 μm (about 6 mil) from each other, and the central insulation layer 21 has a thickness of about 50 μm, with a tolerance of a maximum of ±5 μm.

A practical implementation of the flat cable depicted in FIG. 1 has excellent properties with respect to bendability and flexing resistance, as well as with respect to uniformity of impedance, and has a suitability for a data transmission speed into the range beyond 2 Gbit/s, depending on the length of the flat cable.

Figure 2:
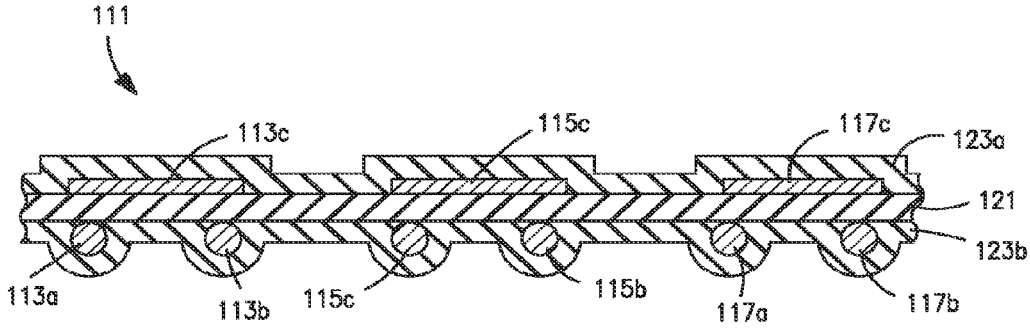
FIG. 2 shows a second embodiment of a flat cable according to the invention.

FIG. 2 shows in a cross-sectional view a embodiment of a flat cable 111 according to the invention, in which electrical round conductors are arranged in the lower conductor plane, which form three signal conductor pairs 113*a*, 113*b* or 115*a*, 115*b* or 117*a*, 117*b*, which can be used in pairs for differential signal transmission. In the upper conductor plane, wide, flat conductors 113*c*, 115*c* and 117*c* are found, which are assigned to each of the signal conductor pairs of the lower conductor plane and have a width and position, so that each of the wide, flat conductors 113*c*, 115*c* and 117*c* spans, but does not necessarily extend beyond the corresponding signal conductor pairs 113*a*, 113*b*, or 115*a*, 115*b* or 117*a*, 117*b*. The wide, flat conductors 113*c* to 117*c* form a reference potential conductor for the corresponding conductor pairs 113*a* to 117*b*. The spacing of the corresponding two round conductors on the lower conductor plane from the corresponding wide, flat conductors on the upper conductor plane is decisive for the impedance of the corresponding signal conductor pair. This spacing, as in the case of FIG. 1, is formed by a central insulation layer 121, which keeps the round conductor and the corresponding wide, flat conductor at a defined and uniform spacing. As in FIG. 1, outer insulation layers 123*a* and 123*b* in this embodiment take over insulation between the individual conductors relative to each other and the corresponding flat cable exterior.

In this embodiment, PTFE, especially ePTFE, are also suitable as materials for the insulation layers 121, 123*a* and 123*b*, again considering the aforementioned hardness ratios between the ePTFE of the central insulation layer 121 and the ePTFE of the two outer insulation layers 123*a* and 123*b*.

In a practical implementation of a flat cable according to FIG. 2, the two round conductors belonging to a signal conductor pair, for example, 113*a* and 113*b*, have a center spacing of about 0.28 mm (about 11 mil), the wide conductors 113*c*, 115*c*, 117*c* each have a width of about 0.4 mm (about 16 mil) and a mutual spacing of about 0.5 mm (about 20 mil). The spacing between the round conductors 113*a* to 117*b* and the wide conductors 113*c* to 117*c*, determined by the central insulation layer 121, is then about 0.05 mm (about 2 mil).

Figure 3:
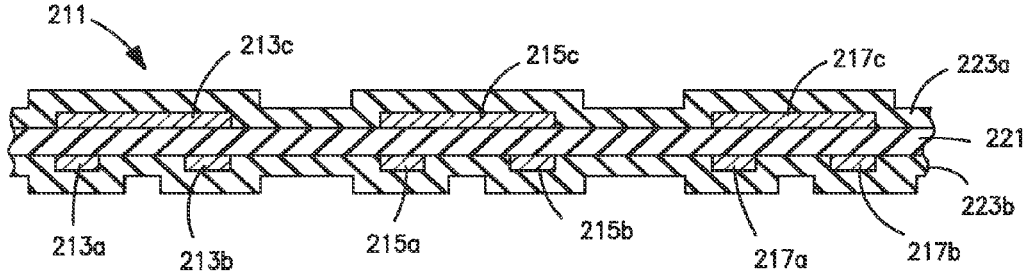
FIG. 3 shows a third embodiment of a flat cable according to the invention.

FIG. 3 shows in a cross-sectional view a embodiment of a flat cable 211 according to the invention, which agrees with the embodiment shown in FIG. 2, with the exception that the signal conductors of the lower conductor plane, the signal conductor pairs 213*a*, 213*b*, or 215*a*, 215*b* or 217*a*, 217*b* are designed as narrow, flat conductors, the conductors of the upper conductor plane, as in the case of FIG. 2, are formed as wide, flat conductors 213*c*, 215*c* and 217*c*. With respect to the materials for the central insulation layer 221 and outer insulation layers 223*a* and 223*b*, the same things apply as in the embodiment according to FIG. 2. ePTFE is again particularly preferred for these insulation layers, with consideration of the already mentioned hardness ratios.

In a practical implementation of the flat cable with the structure depicted in FIG. 3, the narrow, flat conductors 213*a* to 217*b* have a width of about 0.15 mm (about 6 mil), the wide, flat conductors 213*c* to 217*c* have a width of about 0.46 mm (about 18 mil) and the spacing determined by the central insulation layer 221 between the narrow, flat conductors 213*a* to 217*b* and the wide, flat conductors 213*c* to 217*c* is about 0.06 mm (about 2.3 mil).

In the two embodiments according to FIGS. 2 and 3, the flat conductors all have a thickness of about 0.03 mm (about 1 mil).

In the practical implementations of the wide, flat cable according to FIGS. 2 and 3, the round conductors each have a diameter corresponding to AWG 36 and smaller, which corresponds to a round conductor diameter of about 0.127 mm nominal and smaller.

Investigations on practical implementations of the flat cable depicted in FIGS. 2 and 3 have shown that these are particularly suitable for high-speed data transmission into the range above 2.5 Gbit/s. These cables are also characterized by high flexibility and flexing resistance and by high uniform impedance.

In a practical implementation of the flat cable depicted in FIG. 1 as a micro flat cable with 2×16 round conductors, i.e., 16 round conductors per conductor plane, its two external round conductors of the same conductor plane have a center spacing of 4.6 mm, with a center spacing between adjacent conductors in the range from about 0.2 mm (9 mil) to 0.3 mm (12 mil). In the practical embodiments, 4 to 32 conductors are used per conductor plane.

The number of conductors in the embodiments depicted in FIGS. 2 and 3 can also be chosen variably, corresponding to the requirements.

In all depicted embodiments, materials commonly used for high-frequency cable are suitable, like silver-plated copper (SPC), pure copper, galvanized copper, high-strength copper alloys, with or without surface refinement, gold and silver.

In addition to PTFE and ePTFE, polyethylene and polyester and their foamed embodiments are also suitable as insulation materials for the insulation layer.

Figure 4:
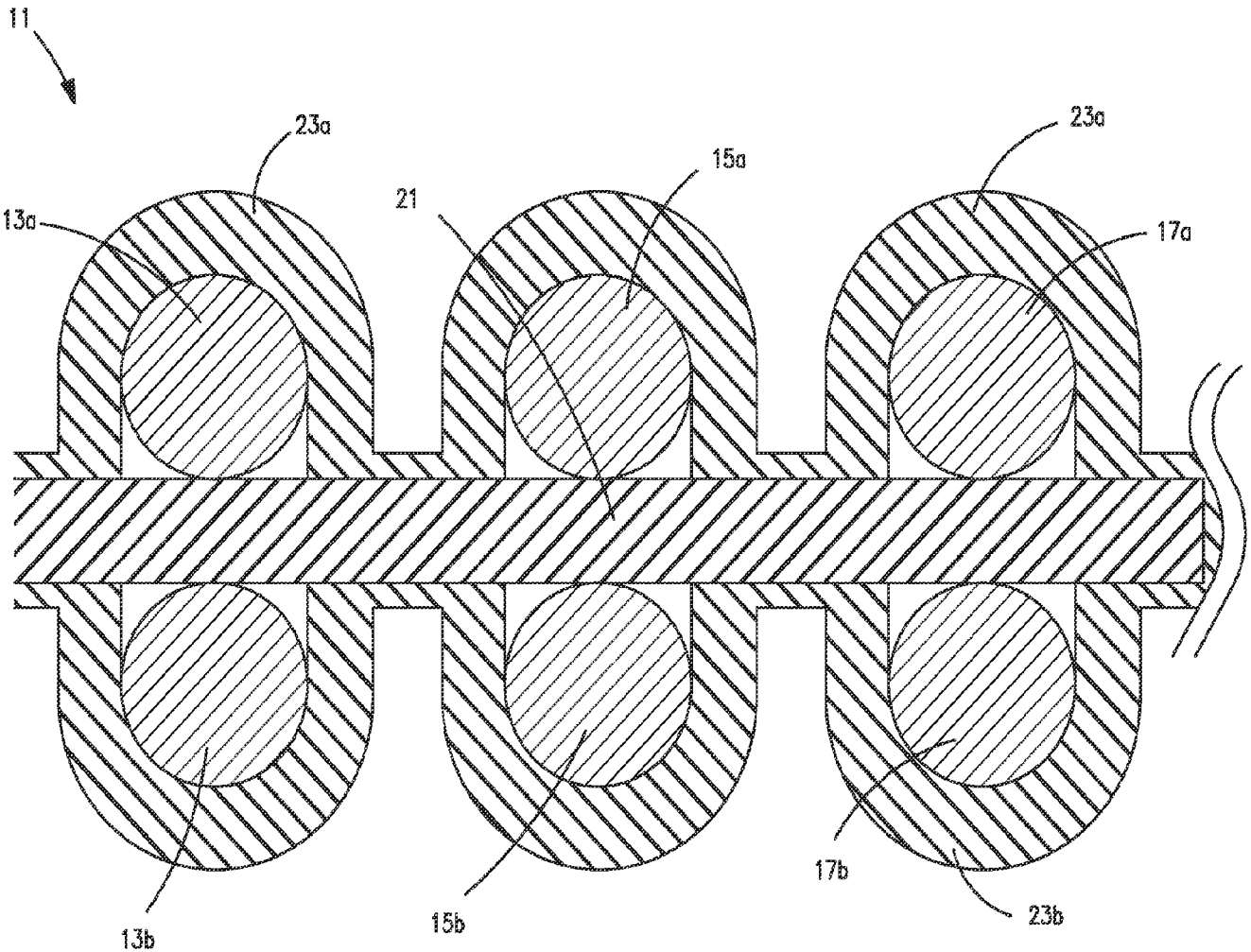
FIG. 4 shows another enlarged cross-sectional view of a flat cable of the design depicted in FIG. 1.

The structure of a flat cable of the type depicted in FIG. 1 is shown again in FIG. 4 in an enlarged view. A method for the production of such flat cable is now explained with reference to FIGS. 5 to 8, in which different production phases are shown, each in a cross-sectional depiction.

Figure 5:
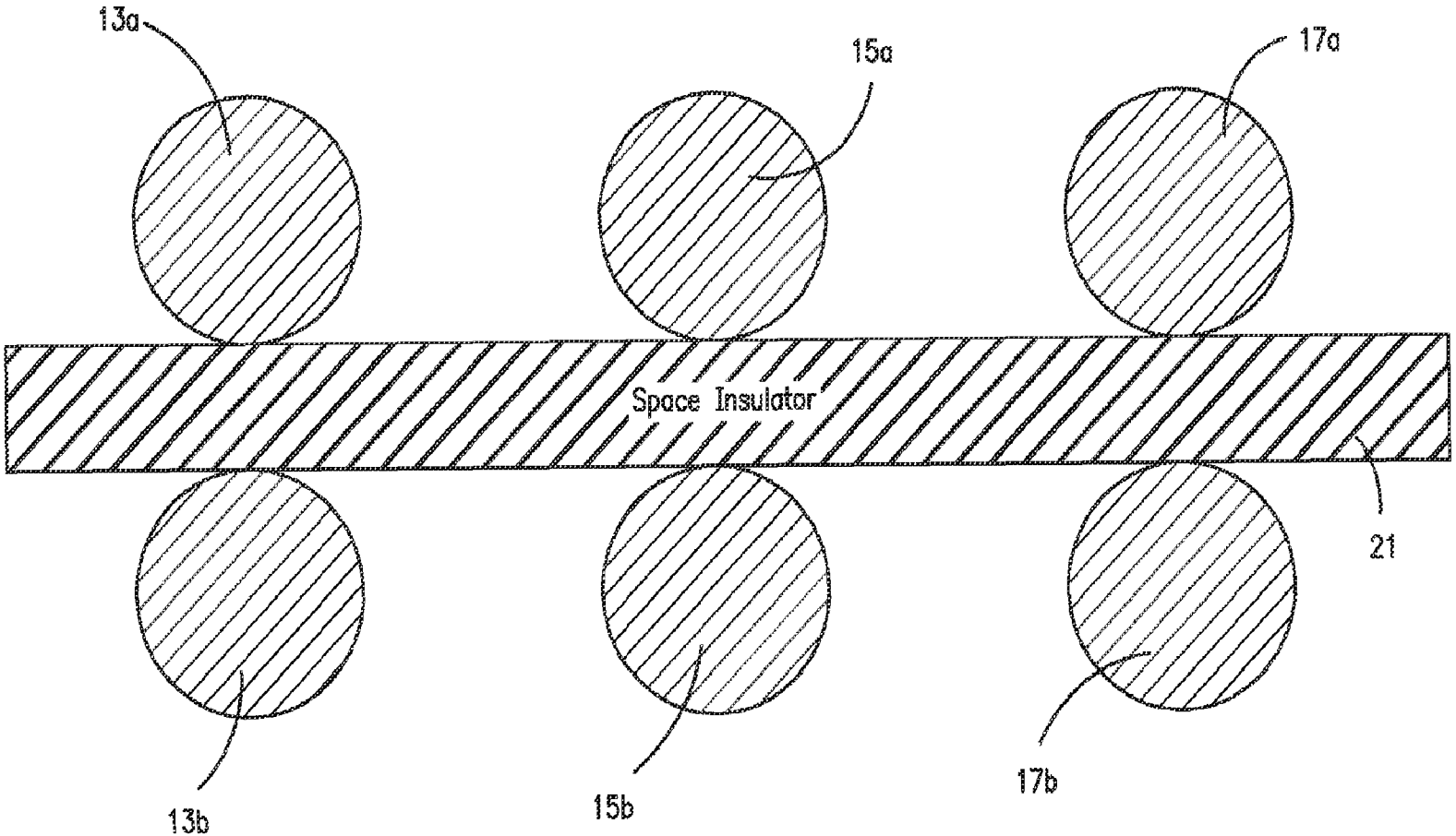
FIGS. 5 to 8 show cross-sectional views during some production phases in the production of the flat cable depicted in FIG. 4.

In the production phase depicted in FIG. 5, three round conductors 13*a*, 13*b*, 15*a*, 15*b*, 17*a* and 17*b* are arranged, purely as an example, on both sides of the central insulation layer 21. Since the round conductors 13*a* to 17*b* are kept at a spacing from the central insulation layer 21, the term spacer insulator is also used in conjunction with these figures for the central insulation layer 21. The round conductors 13*a* to 17*b*, which are very thin, fine wires in the case of a micro flat cable, are positioned precisely by means of a tool opposite each other on the spacer insulator 21.

The spacer insulator 21, together with the wire diameter of the round conductors 13*a* to 17*b*, determines the transmission properties of a flat cable.

Figure 6:
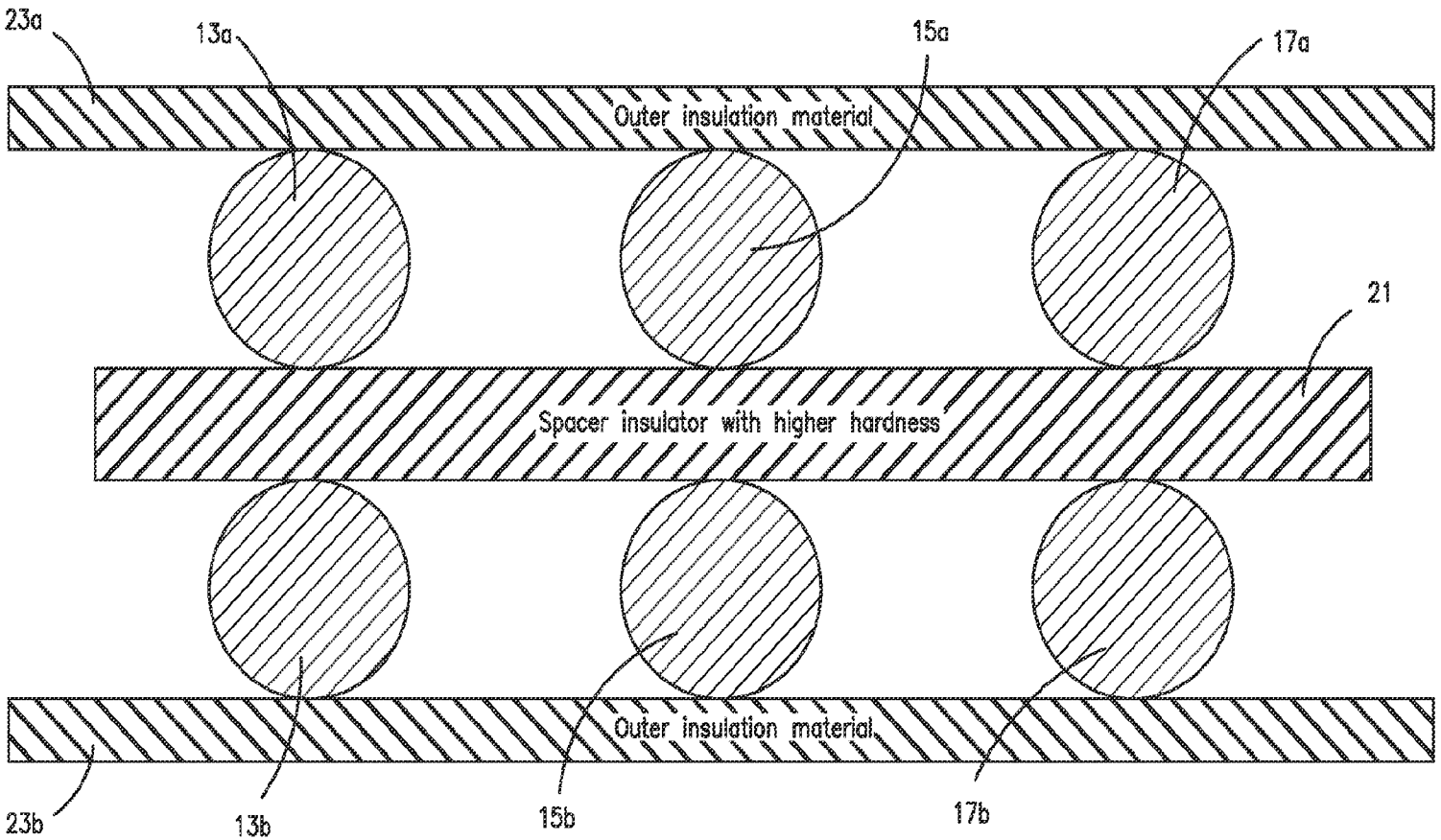

FIG. 6 shows the production phase, in which an outer insulation layer 23*a*, 23*b* has been positioned on the top and bottom of round conductors 13*a* to 17*b*. The outer insulation layers 23*a*, 23*b* are also referred to as outer insulation material in FIGS. 6 and 7.

Figure 7:
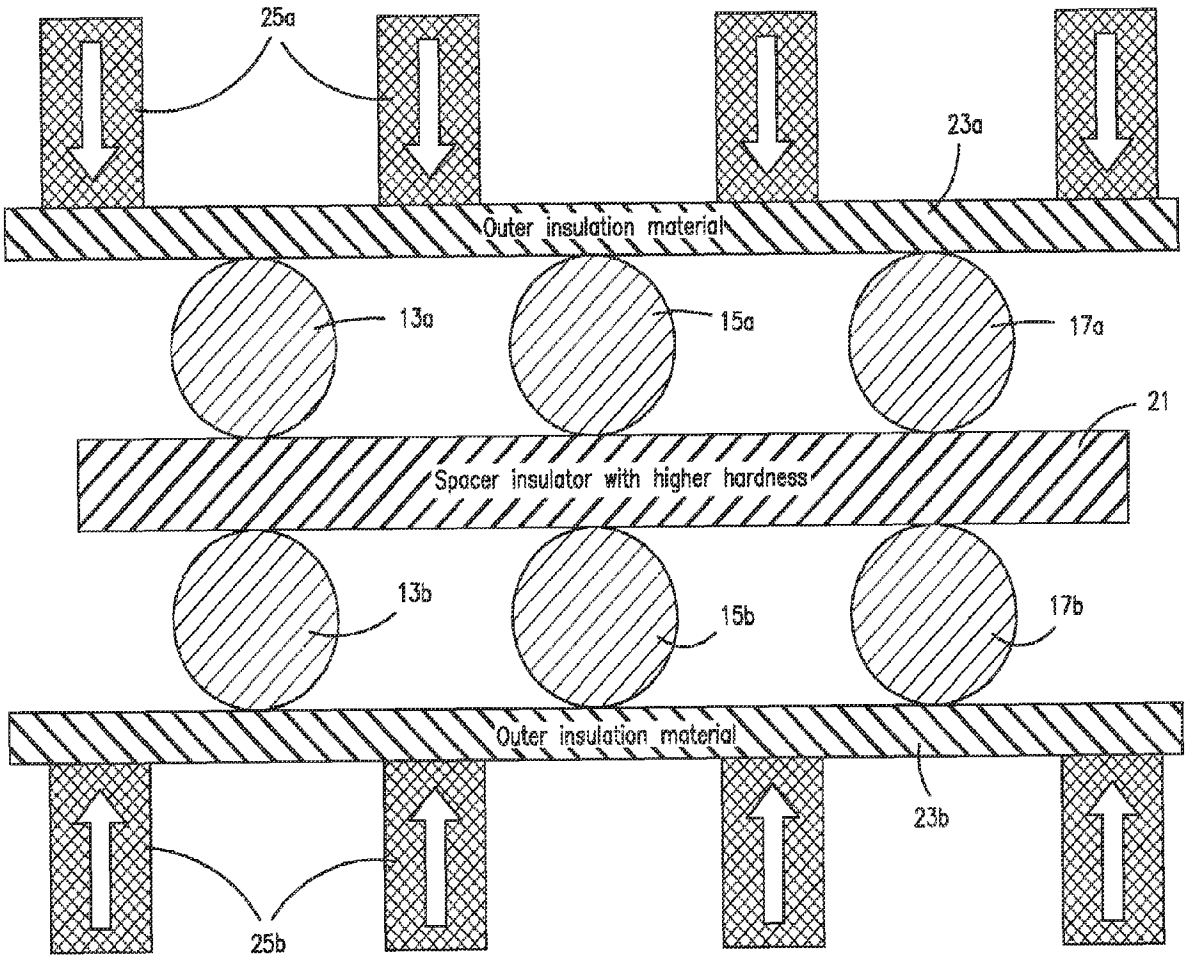
Figure 8:
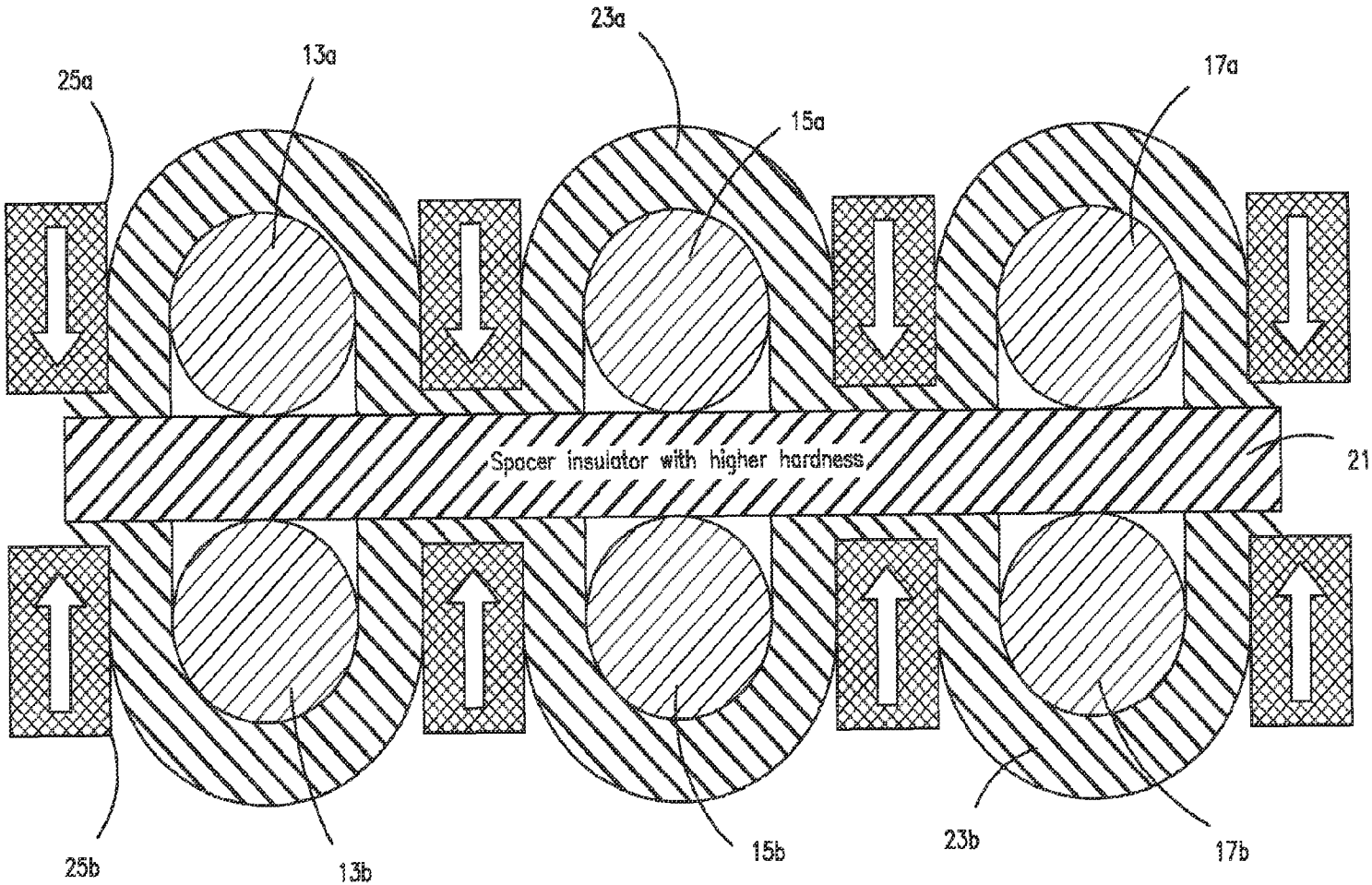

In the production phase depicted in FIG. 7, rotating extrusion punches 25*a* and 25*b* are used from the two outsides of the two outer insulation layers 23*a* and 23*b*. As shown schematically, these are shaped, so that they have die regions in the intermediate spaces between each pair of adjacent round conductors and next to the outer round conductors 13*a*, 13*b* and 17*a*, 17*b*, in order to form the outer insulation material 23*a*, 23*b* around the individual round conductors 13*a* to 17*b* in the manner depicted in FIG. 8, and to press the round conductors 13*a* to 17*b* onto the spacer insulator 21. The extrusion punches 25*a*, 25*b* then compress the outer insulation material between round conductors 13*a* to 17*b*. The insulation materials are then glued to each other, for which purpose either an adhesive can be used, or gluing by melt heating of the insulation material during the compression process, in which the heat of melting can be supplied by heating the extrusion punches 25*a* and 25*b*.

In one embodiment, the rotating extrusion punches form a part of a roll arrangement with two rolls, mounted to rotate, arranged parallel to each other, each of which has on its outer periphery a number of annular grooves spaced axially from each other to guide an electrical conductor. The two rolls are set at a radial spacing from each other, so that a gap is formed between them, with a gap thickness that is less than the sum of the thicknesses of the three participating insulation layers by a predetermined amount. The flat cable components forming the flat cable, namely, the electrical conductors, the spacer insulator and the two outer insulation materials, are supplied to the gap from one side, pressed together in the gap and glued and leave the roll arrangement on the other side of the gap as flat cable.

In principle, an arrangement, as shown in EP 1 271 563 A1 and EP 0 903 757 B1, is suitable as a roll arrangement, after adaptation to the requirements for the production of the flat cable according to the invention. In the case according to the invention, the feed side of the roll arrangement, viewed from the top down, is supplied the upper outer insulation layer 23*a*, the upper conductors 13*a*, 15*a* and 17*a*, the central insulation layer 21, the lower conductors 13*b*, 15*b* and 17 and the lower outer insulation layer 23*b*, in which, here again, the roll annular grooves depicted in the mentioned documents ensure correct positioning of conductors 13*a*-17*b*.

As already mentioned, a material selection is made for the central insulation layer 21 and the outer insulation layers 23*a* and 23*b*, so that the central insulation material or the spacer insulator has a higher hardness than the outer insulation material in such a way, that at the pressure exerted during the compression process by the electrical conductors, essentially only the outer insulation material, but not the central insulation material, is displaced, and the thickness of the central insulation layer is therefore maintained essentially unchanged.

Figure 9:
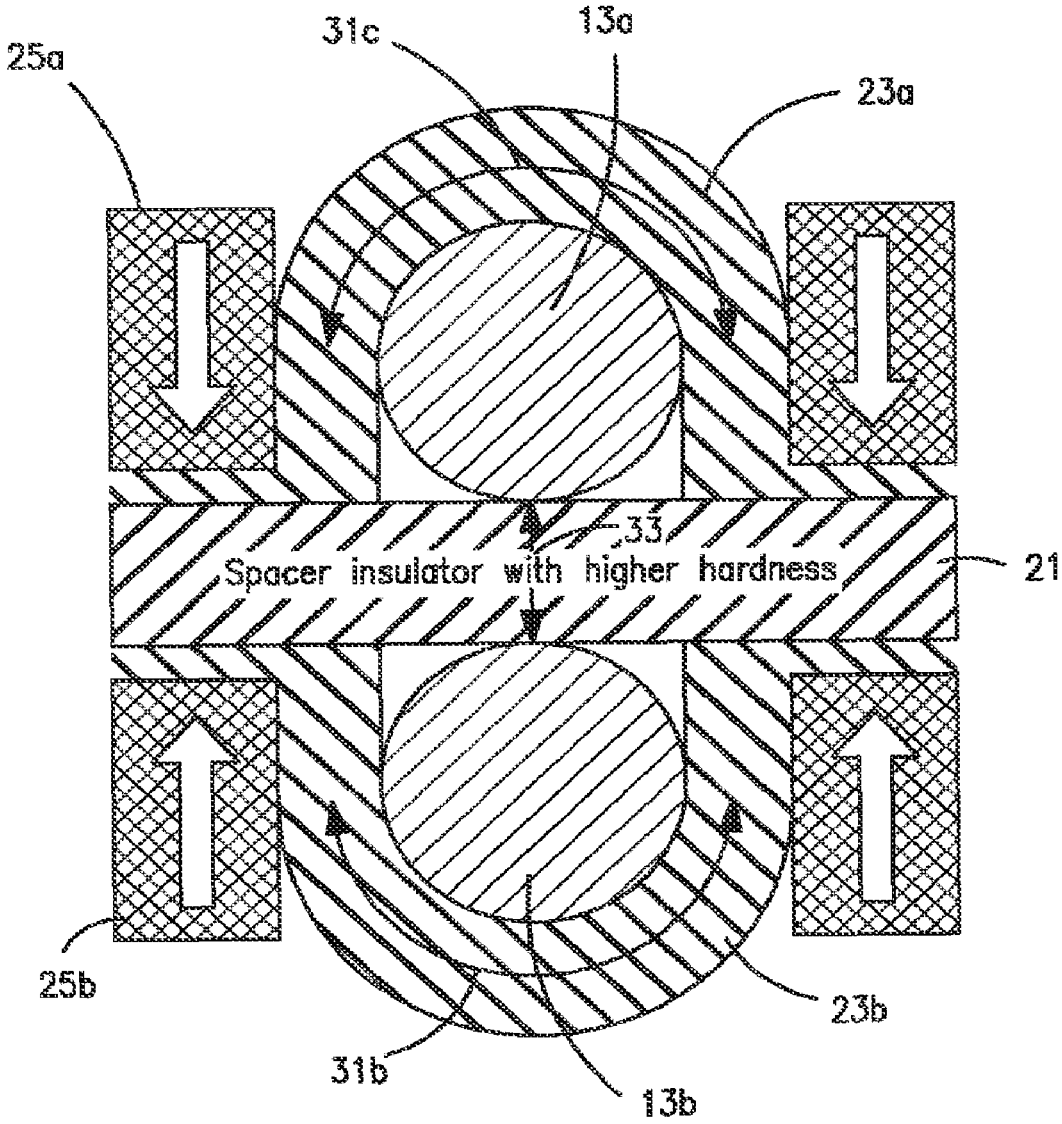
FIG. 9 shows a view to explain the effects of different degree of hardness for the different insulation materials.

This is explained further with reference to FIG. 9. During the compression process exerted by means of extrusion punches 25*a*, 25*b*, elongation of the outer insulation 23*a*, 23*b* occurs by wrapping of the corresponding round conductor 13*a* to 17*b* during shaping. During this compression process, which is indicated by white arrows, the outer insulation material must be elongated. The resistance to elongation of the outer insulation material, indicated by round arrows 31*a* and 31*b*, must be smaller than the mechanical resistance force of the spacer insulator 21 against its residual deformation, indicated in FIG. 9 with a straight double arrow 33. This is achieved in that insulation materials with lower resistance force to transverse elongation are processed for the outer insulation, but materials with higher hardness are used for the spacer insulator 21.

Special aspects of the flat cable, according to the invention, with particularly good suitability for differential signal transmission in the range of very high frequencies lying in the GHz range, are considered with reference to FIGS. 10 to 16. An insertion loss that has the most uniform possible curve, as a function of frequency, i.e., an attenuation curve with the lowest possible attenuation disturbances or dips, at whose frequencies a significant attenuation increase occurs, is sought for differential signal transmissions in the GHz range.

Figure 10:
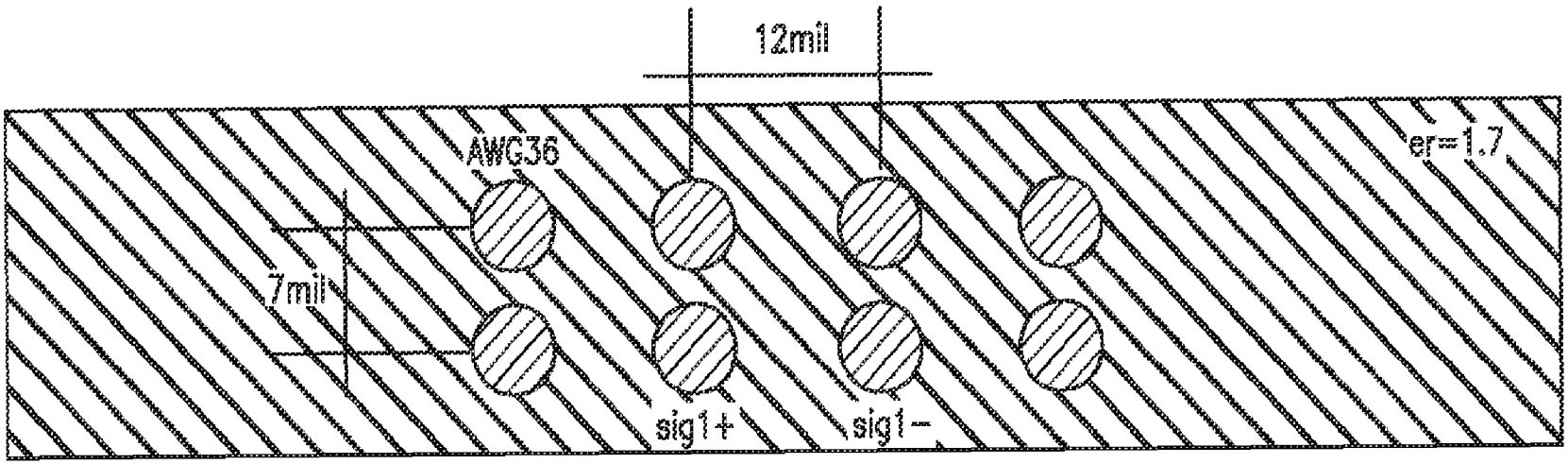
FIG. 10 shows a schematized cross-sectional view of a flat cable according to the invention with a conductor structure corresponding to the flat cable according to FIG. 1 with two layers of ground conductors, which is referred to as micro cable, because of its dimensions.
Figure 11:
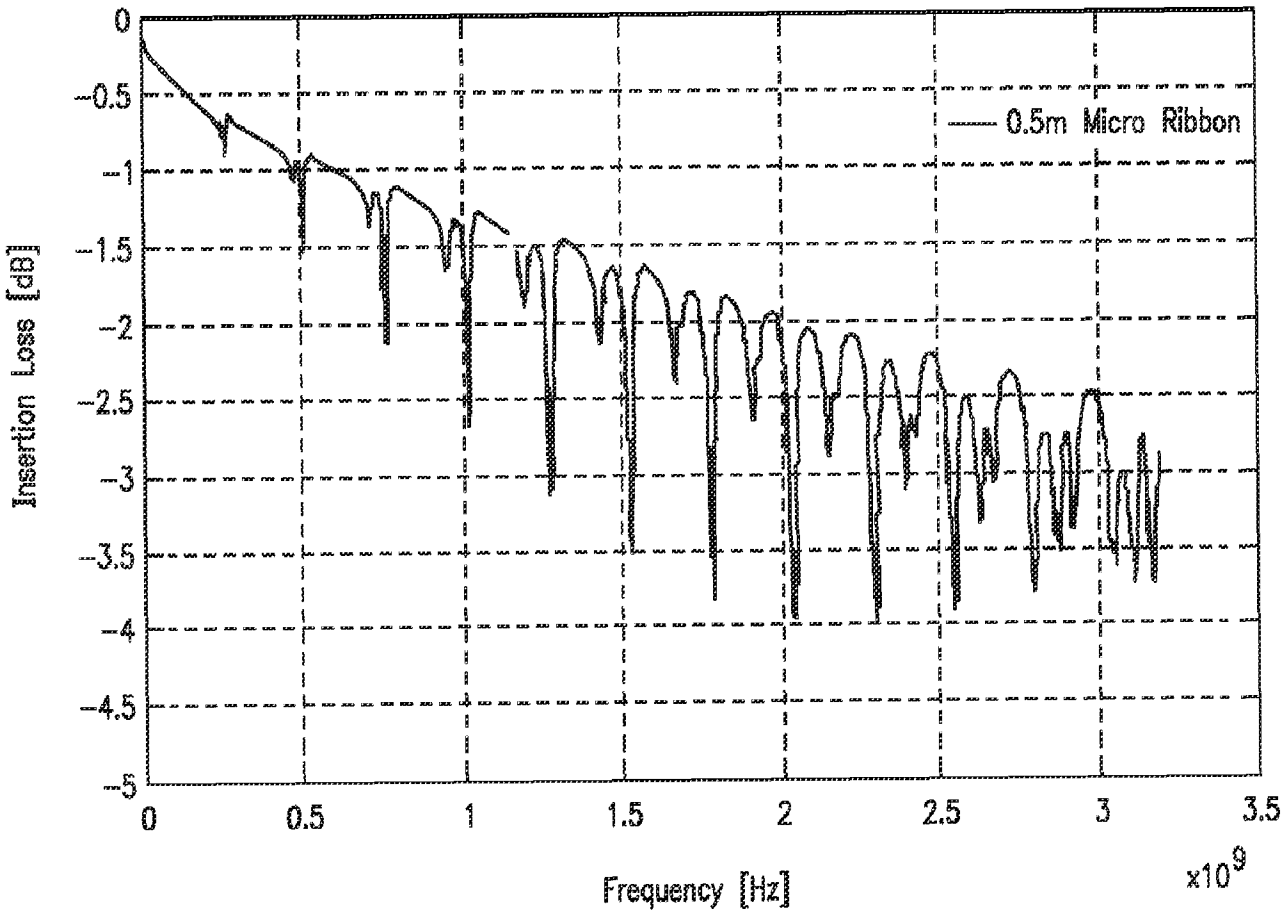
FIG. 11 shows the curve of insertion loss as a function of the frequency in the micro cable according to FIG. 10.
Figure 12:
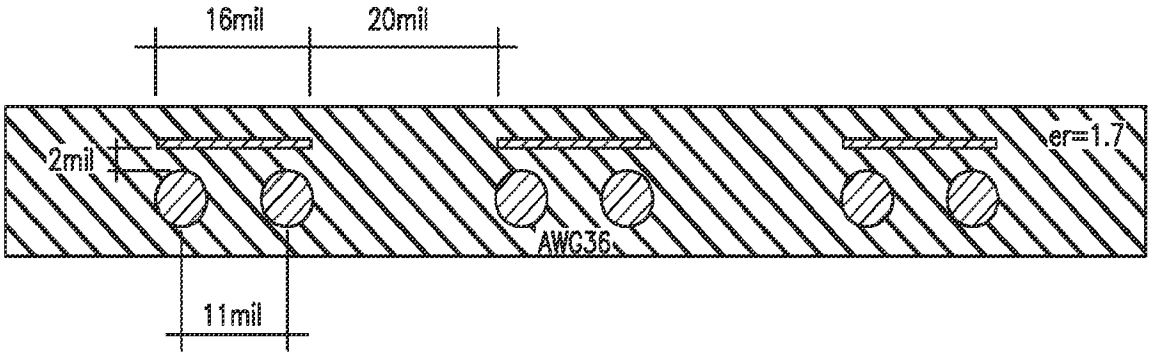
FIG. 12 shows a schematized, cross-sectional view of a flat cable according to the invention with a conductor structure corresponding to a flat cable according to FIG. 2 with a layer of round conductors and a layer of wide, flat conductors, in which a micro cable is also involved.
Figure 13:
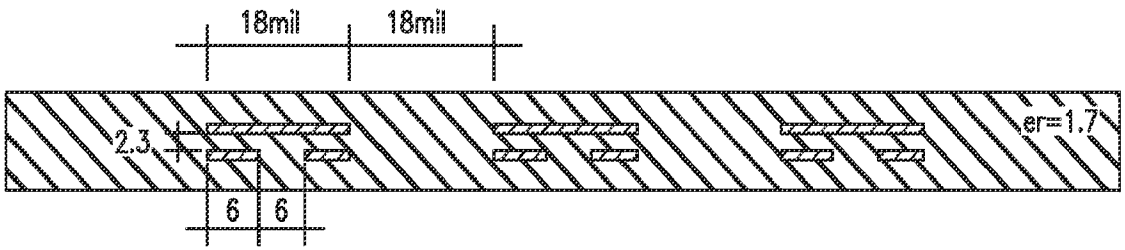
FIG. 13 shows a schematized, cross-sectional view of a flat cable according to the invention with a conductor structure corresponding to the flat cable according to FIG. 3 with a layer of narrow, flat conductors and a layer of wide, flat conductors, in which a micro cable is also involved.

These flat cables, with respect to conductor dimensions and conductor spacings, have very limited dimensions and are therefore referred to as micro cables. Examples of such dimensions are shown in FIGS. 10, 12 and 13, in which 1 mil is 1/1000 inch and corresponds to 0.0254 mm. The dimension mil is particularly common in conjunction with conductor dimensions of cables.

FIG. 10 shows a micro flat cable according to the invention in a schematized cross-sectional view with a conductor structure according to the flat cable depicted in FIG. 1, i.e., a flat cable with two layers of round conductors, lying one above the other. In the case of differential signal transmission, two adjacent conductors of a layer each form a signal conductor pair, and the two opposite conductors of the other layer a corresponding reference potential or ground conductor pair. This micro flat cable has fairly distinct and relatively deep dips in the insertion loss curve depicted in FIG. 11.

FIGS. 12 and 13 show schematized cross-sectional views of the micro flat cables according to the invention with a conductor structure with a layer of narrow conductors, in which round conductors are involved in the case of FIG. 12 and flat conductors in the case of FIG. 13, and a layer of wide, flat conductors, each of which have a width and relative position, so that they span an adjacent signal conductor pair of the other layer over its entire width. In the case of differential signal transmission, two adjacent narrow conductors of a layer then form a signal conductor pair and the opposite wide conductors of the other layer form a corresponding reference potential or ground conductor. Such micro flat cable has an insertion loss curve depicted in FIG. 14, which is essentially smooth in comparison to the insertion loss curve in FIG. 11 of the cable structure according to FIG. 10.

Figure 15:
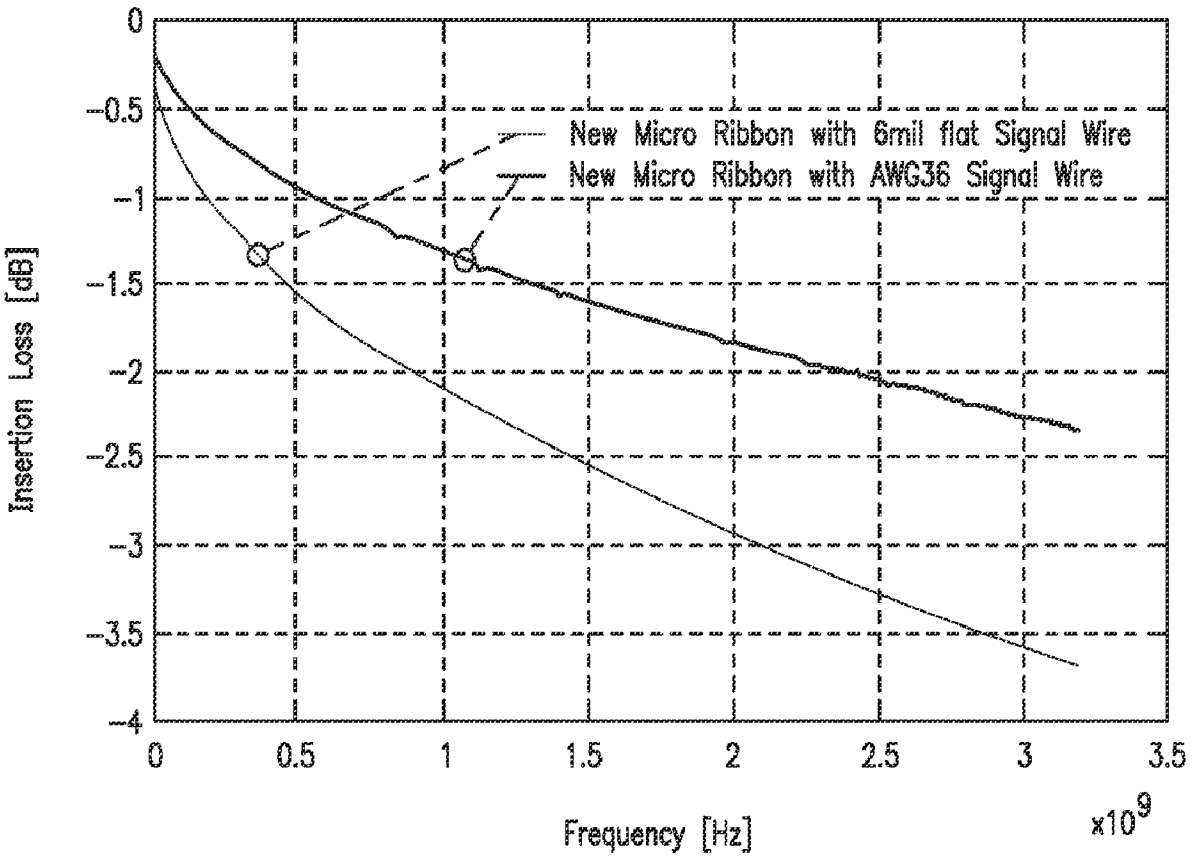
FIG. 15 shows the curve of insertion loss as a function of frequency in the micro cable according to FIGS. 12 and 13.

Insertion loss curves, as a function of frequency for the two different micro cables structures according to FIGS. 12 and 13, are shown separately in FIG. 15. The insertion loss curve is shown in the lower curve for the micro flat cable with round signal conductors depicted in FIG. 12 and the insertion loss curve is shown in the upper curve for the micro flat cable with flat signal conductors depicted in FIG. 13.

Figure 14:
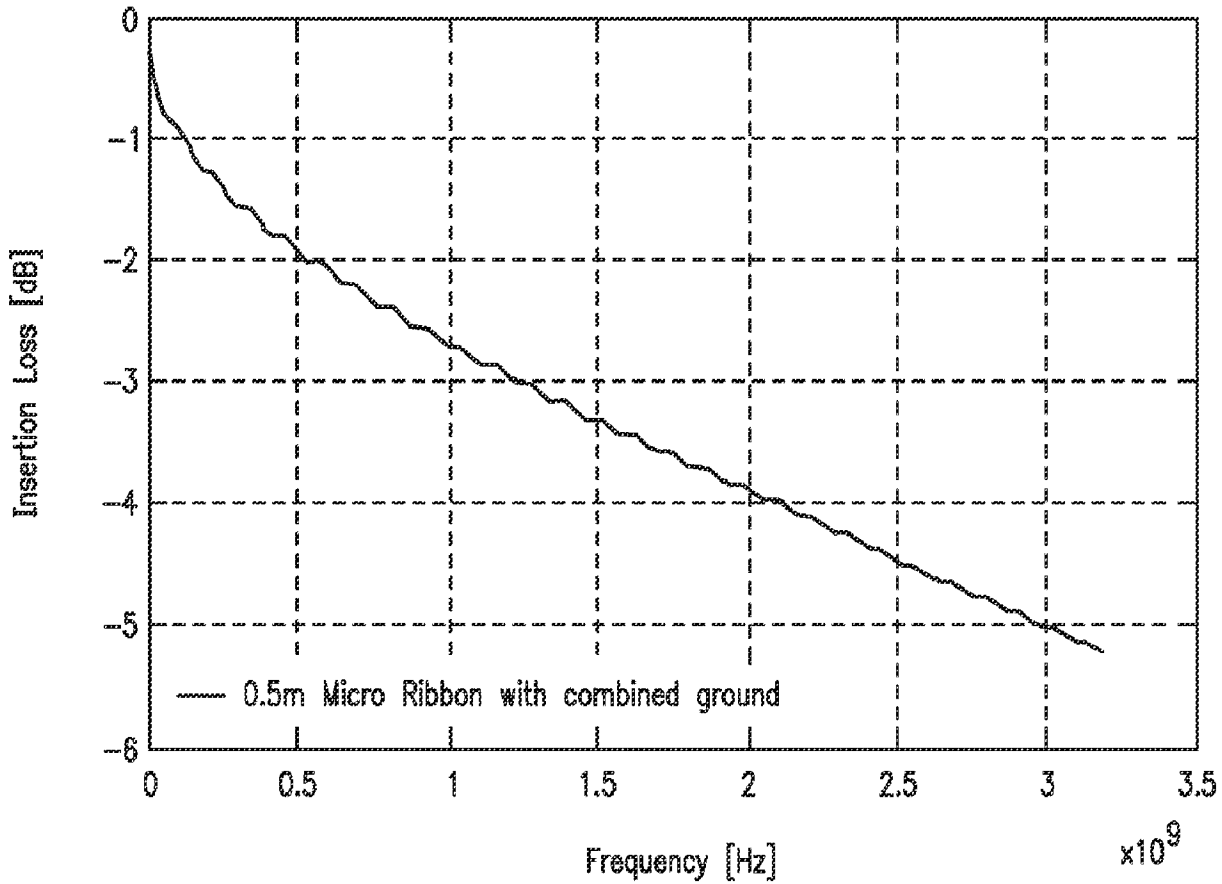
FIG. 14 shows the curve of insertion loss as a function of frequency in a micro cable with a common ground conductor for each signal conductor pair.

In the micro flat cable with the structure according to FIGS. 1 and 10, in which the two signal conductors of a signal conductor pair lie opposite a ground conductor and are connected to it, the coupling inductances and coupling capacitances between the two ground conductors of each ground conductor pair have an interfering effect in the high-frequency range. The results of this are the dips in the insertion loss curve, observable in FIG. 11. In a micro flat cable with a common ground conductor for each signal conductor pair, such coupling inductances and coupling capacitances become zero. As a result of this, a virtually smooth insertion loss curve is obtained, as can be seen in FIGS. 14 and 15.

The result of this finding, which occurred in conjunction with the invention, is that, if differential signal transmission in the high-frequency range is involved, for example, of 2.5 GHz, a micro flat cable with a common ground conductor for the corresponding signal conductor pair should preferably be used.

The teachings of the present invention are therefore that, if the most uniform possible curve of surge impedance matters over the cable length, flat cables should be used in which a material selection is made according to claim 1 for the central insulation layer and the outer insulation layers, so that the central insulation material has a greater hardness than the outer insulation layer materials, so that, when an increasing compression force, acting in the flat cable thickness direction, is exerted on the flat cable by the electrical conductors, the outer insulation layer material is essentially displaced rather than the central insulation layer material.

Another teaching of the invention is that, in the case of differential signal transmission in the high-frequency range, a flat cable should be used, which has a common reference potential or ground conductor per signal conductor pair, which extends over the entire width of the two signal conductors of the corresponding signal conductor pair.

Particularly good signal transmission properties are obtained, if these two teachings of the invention are combined.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. Flat cable comprising at least two conductor planes each with a plurality of electrical conductors running in a longitudinal direction of the flat cable, said electrical conductors kept at a defined distance from one another in a direction of at least one of the flat cable thickness and the flat cable width by a central insulating layer of a predetermined thickness, said electrical conductors electrically insulated and positioned in relation to a respective outer side of the flat cable by a respective outer insulating layer, wherein said central insulating layer has a greater hardness than said outer insulating layer, such that, when an increasing compressive force acting in the direction of the flat cable thickness is exerted on the flat cable by the electrical conductors, the outer insulating layer is displaced more readily than the central insulating layer.

2. Flat cable according to claim 1, in which at least some of the electrical conductors are formed by round conductors.

3. Flat cable according to claim 1, in which at least some of the electrical conductors are formed by flat conductors.

4. Flat cable according to claim 2, in which some of the flat conductors are formed as narrow conductors and the rest are formed as wide flat conductors.

5. Flat cable according to claim 4, in which the narrow conductors form pairs of conductors, each with two adjacent narrow conductors.

6. Flat cable according to claim 5, in which each of the pairs of conductors comprising narrow flat conductors in one of the conductor planes is assigned a wide flat conductor of the other conductor plane, the wide flat conductors each having such a width and position that each of them extends widthwise over the entire width of a respectively opposite pair of conductors of the other conductor plane.

7. Flat cable according to claim 6, in which the wide flat conductors are arranged in the one conductor plane and the narrow conductors are arranged in the other conductor plane.

8. Flat cable according to claim 6, in which at least some of the narrow conductors are formed by round conductors.

9. Flat cable according to one of claims 6, in which at least some of the narrow conductors are formed by flat conductors.

10. Use of the flat cable according to claim 6 for differential data transmission, in which one of two mutually adjacent narrow conductors of the one conductor plane forming a pair of signal conductors respectively transmits data pulses in non-negated signal form and the other transmits the data pulses in negated signal form, and a wide flat conductor of the other conductor plane, spanning the respective pair of signal conductors, is used as a reference potential conductor for the respectively associated pair of signal conductors.

11. Flat cable according to claim 4, in which wide flat conductors that are mutually adjacent in the direction of the flat cable width, or adjacent groups of flat conductors, are arranged alternately in the one conductor plane and in the other conductor plane, with correspondingly alternating arrangement of the respectively associated narrow conductors in the one or the other conductor plane, respectively.

12. Flat cable according to claim 1, the central insulating layer and/or outer insulating layers of which are made of PTFE.

13. Flat cable according to claim 12, the central insulating layer and/or outer insulating layers of which are made of ePTFE.

14. A method of using the flat cable according to claim 1 for differential data transmission, in which one of two mutually adjacent electrical conductors forming a pair of signal conductors respectively transmits data pulses in non-negated signal form and the other transmits the data pulses in negated signal form.

15. The method according to claim 14, at least some of the pairs of signal conductors being formed by two adjacent electrical conductors belonging to different conductor planes.

16. The method according to claim 14, at least some of the pairs of signal conductors being formed by two adjacent electrical conductors belonging to the same conductor plane.

* * * * *